US010188924B1

(12) United States Patent
Vickery

(10) Patent No.: US 10,188,924 B1
(45) Date of Patent: Jan. 29, 2019

(54) BALL SPINNING TRAINING APPARATUS AND METHOD

(71) Applicant: Thomas H. Vickery, Edison, NJ (US)

(72) Inventor: Thomas H. Vickery, Edison, NJ (US)

( * ) Notice: Subject to any disclaimer, the term of this patent is extended or adjusted under 35 U.S.C. 154(b) by 0 days.

(21) Appl. No.: 15/783,147

(22) Filed: Oct. 13, 2017

(51) Int. Cl.
*A63B 69/00* (2006.01)
*A63B 23/14* (2006.01)
*A63B 43/02* (2006.01)
*A63B 102/18* (2015.01)

(52) U.S. Cl.
CPC ..... *A63B 69/0073* (2013.01); *A63B 23/14* (2013.01); *A63B 43/02* (2013.01); *A63B 69/00* (2013.01); *A63B 2102/182* (2015.10)

(58) Field of Classification Search
CPC ..... A63B 69/0073; A63B 23/14; A63B 43/02; A63B 69/00; A63B 2102/182
USPC ..... 473/451, 558, 415, 422, 514, 509, 569, 473/426, 596, 424, 458; 446/236, 484; 482/77; 472/25, 135
See application file for complete search history.

(56) References Cited

U.S. PATENT DOCUMENTS 2,765,170 A * 10/1956 Brown ..... A63B 69/0091 473/424
2,831,685 A * 4/1958 Stewart ..... A63H 1/12 446/236
2,935,321 A * 5/1960 Lhotka ..... A63B 15/00 473/558
3,152,803 A * 10/1964 Sain, Jr. ..... A63B 69/0002 473/424
3,509,659 A * 5/1970 Kau ..... A63B 21/0608 446/236
3,901,505 A * 8/1975 Gerechter ..... A63F 7/38 473/570
4,834,657 A * 5/1989 Gonzalez ..... G09B 1/22 273/142 R
4,891,032 A * 1/1990 Davis ..... A63H 33/00 446/484
4,930,773 A * 6/1990 Outlaw ..... A63B 69/0002 473/458
5,045,014 A * 9/1991 Harkins ..... A01K 15/025 446/236
5,125,862 A * 6/1992 Paranto ..... A63H 27/14 446/236
5,261,851 A * 11/1993 Siebert, Jr. ..... A63H 1/00 446/236

(Continued)

OTHER PUBLICATIONS

Image of "TightSpin Trainer" product, for sale on internet.

*Primary Examiner* — Mitra Aryanpour
(74) *Attorney, Agent, or Firm* — Walter J. Tencza, Jr.

(57) ABSTRACT

An apparatus including a bar having a length substantially greater than a width, and a longitudinal axis along its length; a member which is connected to the bar and aligned with the bar along the same longitudinal axis; and connected to the bar so that the member rotates with respect to the bar, about the longitudinal axis. The member may be connected to the bar by a bolt, fixed to the bar by a tension pin which is perpendicular to a length of the bolt and to the length of the bar. The apparatus may include a ball having a bore hole, which enters on a side of the ball, and terminates inside a core of the ball, so that the bore hole does not go all the way through the ball; wherein the member is fixed to the ball, by pressure insertion of the member into the bore hole.

16 Claims, 10 Drawing Sheets

(56) References Cited

U.S. PATENT DOCUMENTS

| | | | | | |
|---|---|---|---|---|---|
| 5,405,139 | A * | 4/1995 | Gagarin | A63B 15/00 | 473/232 |
| 5,423,730 | A * | 6/1995 | Hirsch | A63B 21/06 | 482/92 |
| 5,615,879 | A * | 4/1997 | Bailey | A63B 69/0088 | 473/424 |
| 5,820,495 | A * | 10/1998 | Howland | A63B 69/0002 | 473/451 |
| 6,093,118 | A * | 7/2000 | Simpson | A63B 69/0002 | 473/451 |
| 6,183,336 | B1 * | 2/2001 | Coleman | A23G 3/50 | 446/153 |
| 6,227,988 | B1 * | 5/2001 | Bodman | A63B 65/122 | 473/422 |
| 6,471,606 | B1 * | 10/2002 | Simpson | A63B 69/0002 | 473/451 |
| 7,247,106 | B1 * | 7/2007 | Brandt | A63B 69/0002 | 473/458 |
| 7,775,911 | B2 * | 8/2010 | Zappel | A63B 69/0002 | 473/422 |
| 8,246,495 | B2 * | 8/2012 | James | A63B 15/00 | 473/451 |
| 8,574,102 | B1 * | 11/2013 | Russell | A63B 67/20 | 473/425 |
| 2006/0014597 | A1 * | 1/2006 | Cantu | A63B 69/0002 | 473/422 |
| 2007/0270249 | A1 * | 11/2007 | James | A63B 69/0002 | 473/451 |
| 2015/0018132 | A1 * | 1/2015 | Lovelace | A63B 69/0002 | 473/458 |

* cited by examiner

BALL SPINNING TRAINING APPARATUS AND METHOD

FIELD OF THE INVENTION

This invention relates to devices used for sports training in which a ball can be spun.

BACKGROUND OF THE INVENTION

There is a known product called "The TightSpin Trainer" (trademarked) for wrist exercise or training for softball pitching. This product has a hole drilled all the way through a softball. A bar goes through an entry on one side of the ball and comes out an exit on the other side, and is capped on the other side of the ball. Thus, the entry side, and the exit side of the ball are damaged and have obstructions mounted on them during normal operation of the "The TightSpin Trainer". This is disadvantageous because in order to hold the altered softball, with a pitching grip, one must avoid the two altered or damaged areas. Also, the altered softball of "The TightSpin Trainer" often becomes loose, sliding up and down the bar and/or does not spin properly on the bar. In addition, the "TightSpin Trainer" (trademarked) generally, is not very durable, at least in part because the inside drilled out hole of the altered ball rubs against the bar, further altering the modified ball, and resulting in more looseness and/or an inconsistent spinning, or changing how the ball spins over time. In addition the "TightSpin Trainer" (trademarked) cannot easily be used by one person. There is a need for a better softball ball spinning device and/or a better ball spinning device generally.

SUMMARY OF THE INVENTION

In at least one embodiment, an apparatus is provided comprising a bar having a length and a width, wherein the length is substantially greater than the width, and having a longitudinal axis along its length; a member which is connected to the bar and aligned with the bar so that the member has a longitudinal axis which is the same as the longitudinal axis of the bar; and wherein the member is connected to the bar so that the member rotates with respect to the bar, about the longitudinal axis of the bar.

The member may be connected to the bar by a bolt. The bolt may be fixed to the bar by a tension pin which is perpendicular to a length of the bolt and to the length of the bar. The apparatus may further include a ball having a bore hole, wherein the bore hole enters the ball through a first opening on a side of the ball, and the bore hole terminates inside a core of the ball, so that the bore hole does not go all the way through the ball; and wherein the member is fixed to the ball, by insertion of the member into the bore hole.

In at least one embodiment, the bore hole of the ball has diameter, which has a rest measurement, prior to insertion of the member, which is less than a diameter of the member, so that the bore hole diameter must expand by pressure, in order for the member to be inserted into the bore hole.

The apparatus may further include a first washer connected to the bolt and the member, between a bolt head of the bolt and a first end of the member; and a second washer connected to the member and the bar, between a second end of the member, opposite the first end of the member, and a first end of the bar.

The apparatus may further include a first ball bearing inserted in the member, nearer the first end of the member than the second end of the member; and a second ball bearing inserted in the member, nearer the second end of the member than the first end of the member. The apparatus may further include a nut located between the second washer and the bar.

In at least one embodiment, a method is provided comprising the steps of inserting a member of an apparatus into a bore hole of a ball, to thereby attach the member and the apparatus to the ball, so that the member is fixed to the ball, and the member and the ball rotate with respect to a bar of the apparatus; and wherein the bore hole terminates inside of the ball so that member enters the ball from a first opening on one side of the ball, but the member does not go all the way through the ball.

The bar may have a length and a width, wherein the length is substantially greater than the width, and the bar may have a longitudinal axis along its length. The member may be connected to the bar and aligned with the bar so that the member has a longitudinal axis which is the same as the longitudinal axis of the bar; and wherein the member is connected to the bar so that the member rotates with respect to the bar, about the longitudinal axis of the bar.

The member may be connected to the bar by a bolt. The bolt may be fixed to the bar by a tension pin which is perpendicular to a length of the bolt and to the length of the bar.

In at least one embodiment, prior to insertion of the member into the bore hole of the ball, the member has a diameter and the bore hole has a diameter, and the diameter of the member is greater than the diameter of the bore hole, so that pressure must be applied to insert the member into the bore hole to cause the bore hole diameter to expand.

BRIEF DESCRIPTION OF THE DRAWINGS

FIG. 10 shows a right side view of another apparatus in accordance with an embodiment of the present invention, with the apparatus of FIG. 10 in a third state;

DETAILED DESCRIPTION OF THE DRAWINGS

Figure 1A:
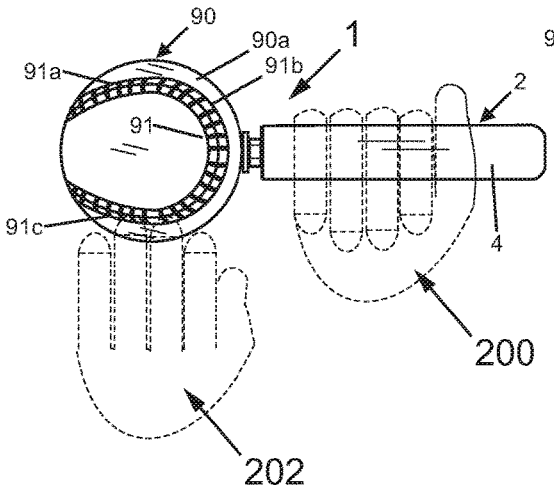
FIG. 1A shows a right side view of an apparatus in accordance with an embodiment of the present invention, with the apparatus of FIG. 1A in a first state, and along with dashed lines for a hand which grips part of the apparatus of FIG. 1A, and another hand which spins a ball of the apparatus of FIG. 1A.
Figure 1B:
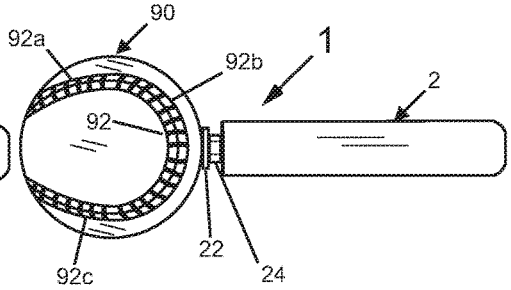
FIG. 1B shows a right side view of the apparatus of FIG. 1A in accordance with an embodiment of the present invention, with the apparatus of FIG. 1A in a second state.
Figure 1C:
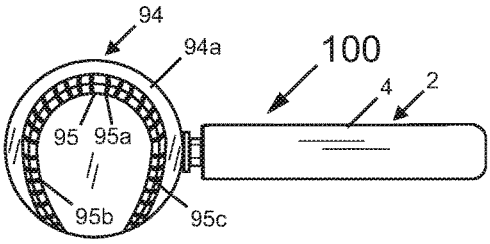
FIG. 1D shows a right side view of the apparatus of FIG. 10 in accordance with an embodiment of the present invention, with the apparatus of FIG. 10 in a fourth state.

FIG. 1A shows a right side view of an apparatus 1 in accordance with an embodiment of the present invention, with the apparatus 1 of FIG. 1A in a first state. FIG. 1B shows a right side view of the apparatus 1 of FIG. 1A in accordance with an embodiment of the present invention, with the apparatus 1 of FIG. 1A in a second state.

The apparatus 1 includes a spinning device 2, and a ball 90. The ball 90 may be a known regulation softball, except as will be described. The ball 90 has seams, including horseshoe or U-shaped portion 91 shown in FIG. 1A, which is connected to horseshoe or U-shaped portion 92, shown in FIG. 1B. The U-shaped portion 91 has seams or portions 91*a* and 91*c* which are substantially parallel to a bar or rod 4 of the spinning device 2, and seams or portion 91*b* which is substantially perpendicular to the bar or rod 4. The U-shaped portion 92 has seams or portions 92*a* and 92*c* which are substantially parallel to a bar or rod 4 of the spinning device 2, and seam or portion 92*b* which is substantially perpendicular to the bar or rod 4.

Figure 1D:
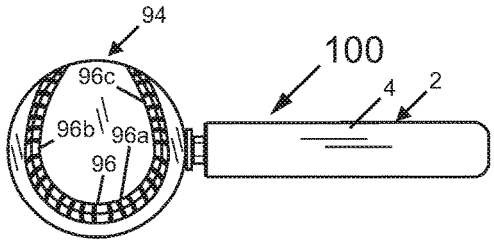

FIG. 10 shows a right side view of an apparatus 100 in accordance with an embodiment of the present invention, with the apparatus of FIG. 10 in a third state. FIG. 1D shows a right side view of the apparatus 100 of FIG. 10 in accordance with an embodiment of the present invention, with the apparatus of FIG. 10 in a fourth state.

The apparatus 100 includes the spinning device 2, and a ball 94. The ball 94 may be a known regulation softball, except as will be described. The ball 94 has seams, including horseshoe or U-shaped portion 95 shown in FIG. 10, which is connected to horseshoe or U-shaped portion 96, shown in FIG. 1D. The U-shaped portion 95 has seams or portions 95*b* and 95*c* which are substantially perpendicular to bar or rod 4 of the spinning device 2, and seams or portion 95*a* which is substantially parallel to the bar or rod 4. The U-shaped portion 96 has seams or portions 96*b* and 96*c* which are substantially perpendicular to a bar or rod 4 of the spinning device 2, and seam or portion 6*a* which is substantially parallel to the bar or rod 4.

The apparatus 1 and 100 are the same, except as will be described. In the apparatus 1, the spinning device 2 is fixed to the ball 90, so that four seams: 91*a*, 91*c*, 92*a*, and 92*c*, will be substantially parallel to the rod or bar 4 of the spinning device 2. In contrast, in the apparatus 100, the ball 94 is attached to the spinning device 2, so that two seams: 95*a* and 96*a*, will be substantially parallel to the rod or bar 4 of the spinning device 2. In apparatus 1, a hole has been drilled part way into the ball 90, at a location, with respect to covering 90*a*, so that the spinning device 2 will be fixed to the ball 90, so that the four seams 91*a*, 91*c*, 92*a*, and 92*c* will be substantially parallel to the rod or bar 4. In apparatus 100, a hole has been drilled part way into the ball 94, at a location, with respect to covering 94*a*, so that only two seams, 95*a* and 96*a*, will be substantially parallel to the rod or bar 4 of the spinning device 2. Otherwise, the apparatus 1 and the apparatus 100 are identical. Both balls 90 and 94 have the same inner ball 80, which will be described below.

Figure 2A:
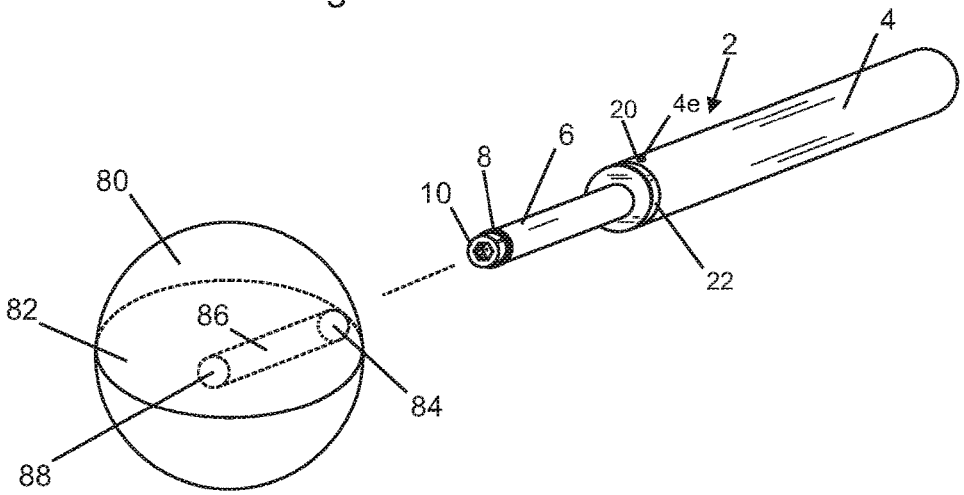
FIG. 2A shows a front, right side, top perspective view of an inner ball, and a spinning device in accordance with an embodiment of the present invention, for use with the apparatus of FIGS. 1A-B or FIGS. 1C-D, with the inner ball and the spinning device separate from each other.
Figure 2B:
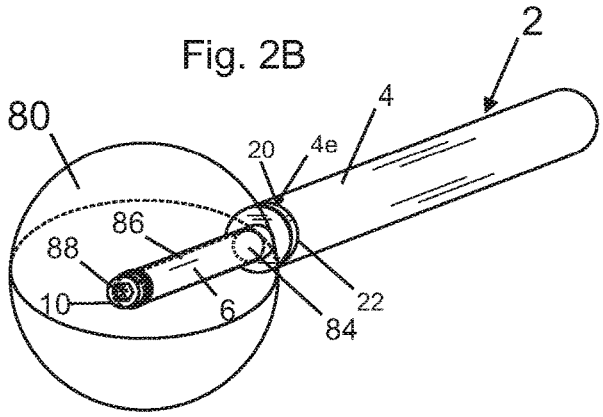
FIG. 2B shows a front, right side, top perspective view of the inner ball, and the spinning device of FIG. 2A, with the device connected to the inner ball, and the inner ball shown as transparent for ease of description.
Figure 2C:
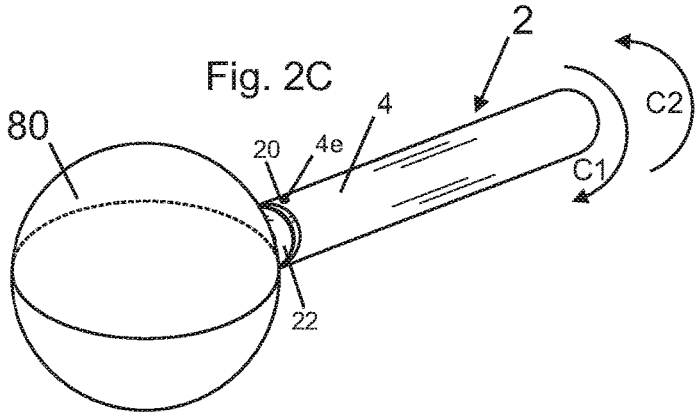
FIG. 2C shows a front, right side, top perspective view of the inner ball, and the spinning device of FIG. 2A, with the spinning device connected to the inner ball, and the inner ball not shown as transparent.

FIG. 2A shows a front, right side, top perspective view of an inner ball 80, and the spinning device 2 in accordance with an embodiment of the present invention, for use with the apparatus 1 or 100 of FIGS. 1A-B or FIGS. 1C-D, respectively, with the inner ball 80 and the spinning device shown separate from each other in FIG. 2A. FIG. 2B shows a front, right side, top perspective view of the inner ball 80, and the spinning device 2, with the spinning device 2 connected to the inner ball 80, and the inner ball 80 shown as transparent for ease of description. FIG. 2C shows a front, right side, top perspective view of the inner ball 80, and the spinning device 2 of FIG. 2A, with the spinning device 2 connected to the inner ball 80, and the inner ball 80 not shown as transparent.

The inner ball 80 is located within each of balls 90 and 94. The inner ball 80 may include a core 82, and an inner cylindrical bore or chamber 86 extending from a circular opening 84 into the inner ball 80, to a termination point 88, such as near the midpoint of the core of the inner ball 80. The inner ball 80 may be identical to the inner core, within a covering of a regulation softball, except for the cylindrical bore or chamber 86, including 84 and 88.

The spinning device 2 includes the rod, bar, or post 4, a member 6, a washer 8, and a bolt 10, and a washer 22. As shown in FIG. 2B, the member 6, washer 8, and bolt 10 are inserted into the bore 86, so that the end or portion 10*a* of the bolt 10 is near or contacts the termination end 88 within the inner ball 80, near the middle, inside the core, of the inner ball 80. In at least one embodiment, the outer diameter of the member 6, D3 shown in FIG. 4B which may be 0.562 inches, is larger than the inner diameter D4, which may be 0.5 inches (at rest), shown in FIG. 3A, of the circular opening 84, and of the bore 86, generally, so that the member 6 has to be injected, into the bore 88, through the opening 84, by pressure, such as by using a drill press or some other machine. Because the core 82 of the inner ball 80 of a regulation softball (or a regulation baseball, and other balls) is elastic, the larger diameter member 6 can be pushed into the bore 86 by sufficient pressure, which causes the diameter of the opening 84 and bore 88 to be forcibly expanded to allow the member 6 to enter. After the member 6 has been inserted, by pressure into the bore 86 as shown in FIG. 2B, the elastic core 82 automatically retracts, holds the member 6 in the bore 86 and keeps the member 6 from falling out of the bore 86. In this manner, the inner ball 80, and consequently the balls 90 and 94 of FIGS. 1A, and 1C, respectively, are only marred or altered on one side or one entry point of the respective balls. In addition, the member 6 is held tightly and does not move with respect to bore 86 or the ball 80, and thus there is no rubbing of member 6 against bore 86, and spinning of the 80 or the balls 90 or 94 with respect to the bar or handle 4, remains consistent over time.

The inner ball 80 (and consequently the balls 90 and 94) can be rotated in a clockwise direction C1, or a counter-clockwise direction C2 with respect to an axis of the bar or member 4, as shown in FIG. 2C.

Figure 3A:
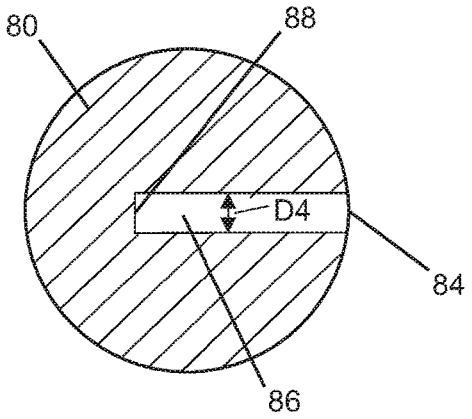
FIG. 3A shows a cross sectional view of the inner ball of FIG. 2A.
Figure 3B:
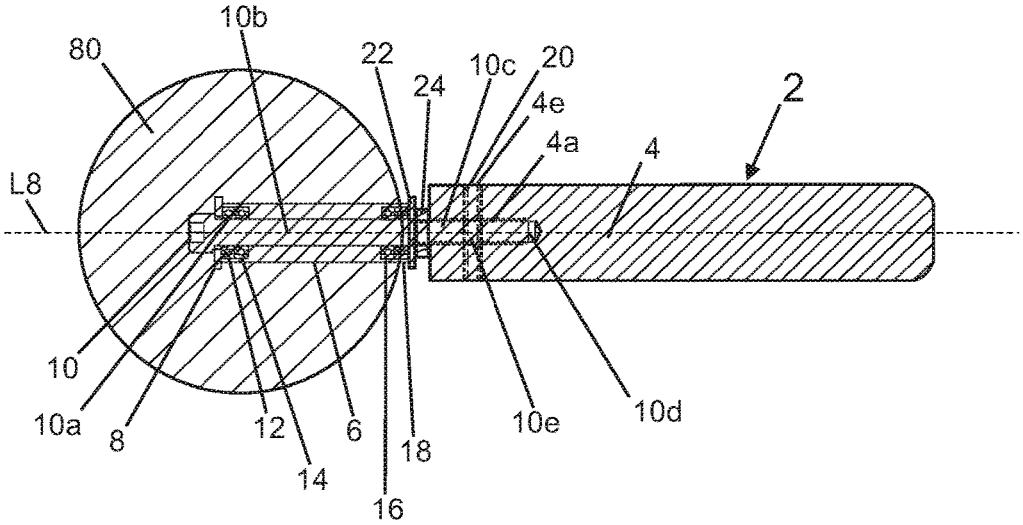
FIG. 3B shows a cross sectional view of the inner ball and the spinning device of FIG. 2A connected to each other.
Figure 6A:
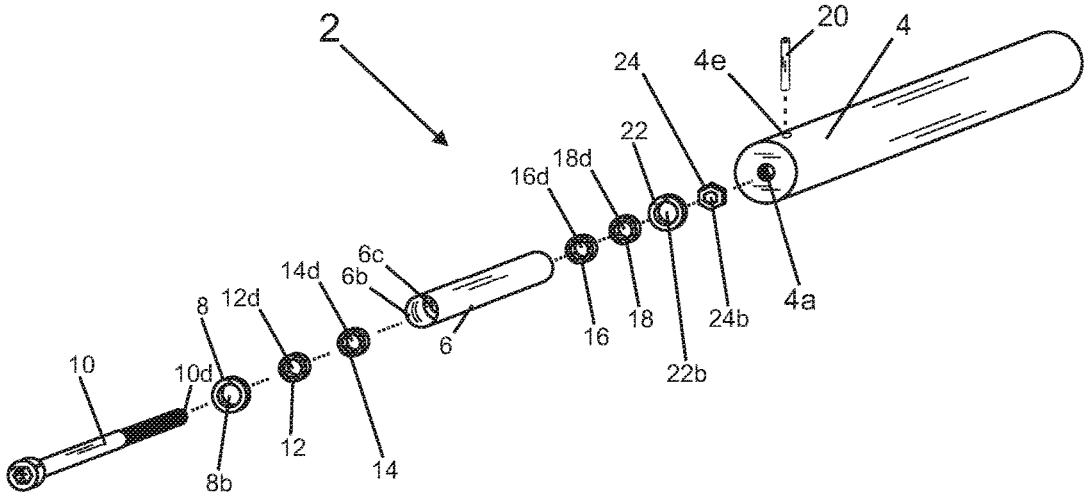
FIG. 6A shows a front, top, and right side perspective view of the spinning device of FIG. 2A, with the spinning device taken apart.
Figure 11A:
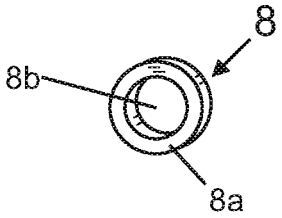
FIG. 11A shows a front, top, and right side perspective view of a washer, used for the spinning device of FIG. 2A.
Figure 11B:
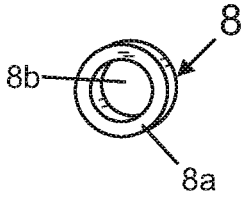
FIG. 11B shows a rear, bottom, and right side perspective view of the washer, used for the spinning device of FIG. 2A.

FIG. 3A shows a cross sectional view of the inner ball 80 of FIG. 2A. FIG. 3A shows the inner diameter D4 of the bore 86, which may be 0.5 inches at rest, i.e. when the bore 86 is not being forcibly expanded by entry of member 6. FIG. 3B shows a cross sectional view of the inner ball 80 and the spinning device 2 of FIG. 2A connected to each other. The spinning device 2 may include bolt 10, washer 8, ball bearings 12 and 14, member 6, ball bearings 16, and 18, washer 22, nut 24, and bar or rod 4. The bolt 10 has a portion or end 10*a*, a non threaded body portion 10*b*, a body portion with outer threads 10*c*, an insertion end 10*d*, and after drilling will have a bore hole 10*e* through bolt 10 perpendicular to the length of the bolt 10. The washers 8 and 22 have cylindrical bodies 8*a* (and corresponding to washer 22, which may be identical) and a central opening 8*b*, and 22*b*, as shown by FIG. 6A, and FIGS. 11A-B, which may have an inner diameter slightly more than the outer diameter of the portion 10*b* of the bolt 10, to allow the bolt 10 to be inserted into the opening 8*b* and the opening 22*b*. The bearing 12 may have an outer cylinder 12*a*, an inner cylinder 12*b*, balls 12*c* between the cylinders 12*a* and 12*b*, and an inner opening 12*d*. The inner opening 12*d* may have a diameter equal to the diameter of the opening 8*b* of the washer 8. The bearings 14, 16, and 18 may be identical to the bearing 12.

The nut 24 shown in FIG. 6A, may have an opening 24*b*, an inner threads through which the end 10*d* of the bolt 10 is inserted.

Figure 8A:
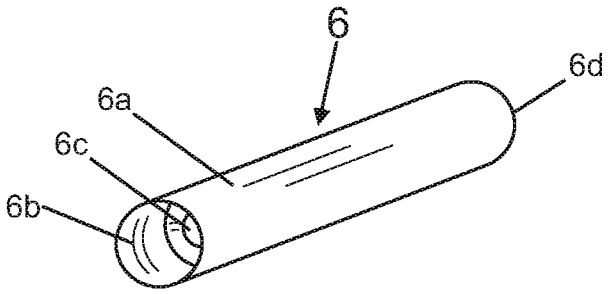
FIG. 8A shows a front, top, and right side perspective view of a member, used for the spinning device of FIG. 2A.
Figure 8B:
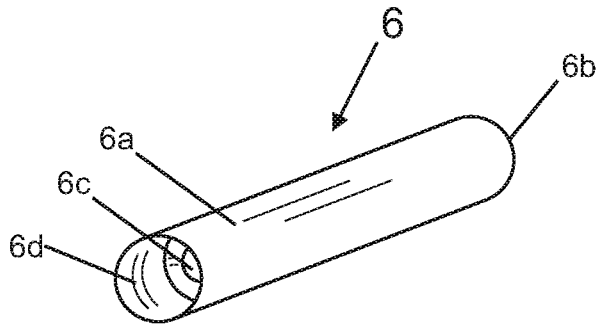
FIG. 8B shows a rear, bottom, and right side perspective view of the member of FIG. 8A; used for the spinning device of FIG. 2A.

The member 6, as shown in FIGS. 8A and 8B, may have a cylindrical body 6*a*, inner regions 6*b* and 6*d*, into which ball bearings are inserted, and region 6*c*, into which portion 10*b* of the bolt 10 is inserted as shown in FIG. 3B. The inner regions 6*b* and 6*d* have larger inner diameters than region 6*c*, to allow ball bearings to be inserted.

The spinning device 2 further includes a tension pin or spring pin 20. In at least one embodiment, the spinning device 2 is assembled as in FIG. 4A, except for opening 4*e* and 10*e*, i.e. bolt 10 is screwed into opening 4*a*, and then an opening 4*e* is drilled through the bar 4 and an aligned opening 10*e* is drilled through the bolt 10, perpendicular to the lengths of the bar 4 and the bolt 10. Then the tension or spring pin 20 is placed in the opening of bores 4*e* and 10*e*, to thereby hold the bolt 10 to the bar 4 and keep the bolt 10 from coming out of the bar 4.

Figure 4A:
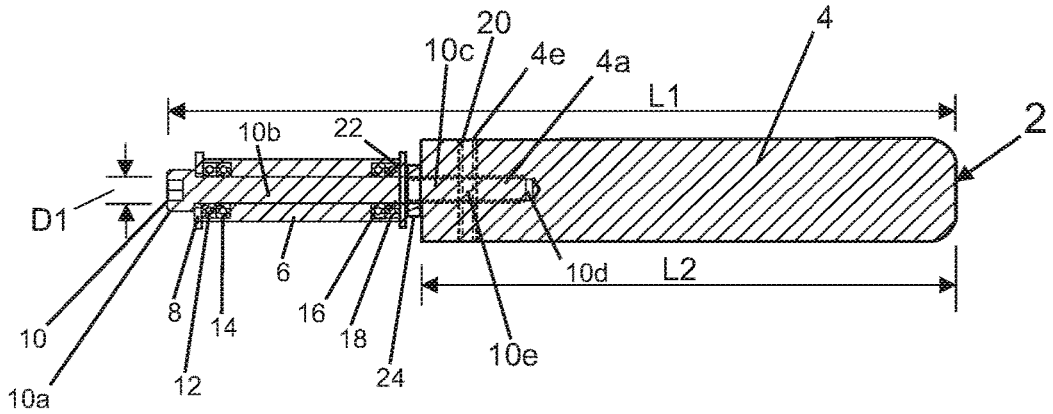
FIG. 4A shows a cross sectional view of the spinning device of FIG. 2A, with the spinning device assembled.
Figure 4B:
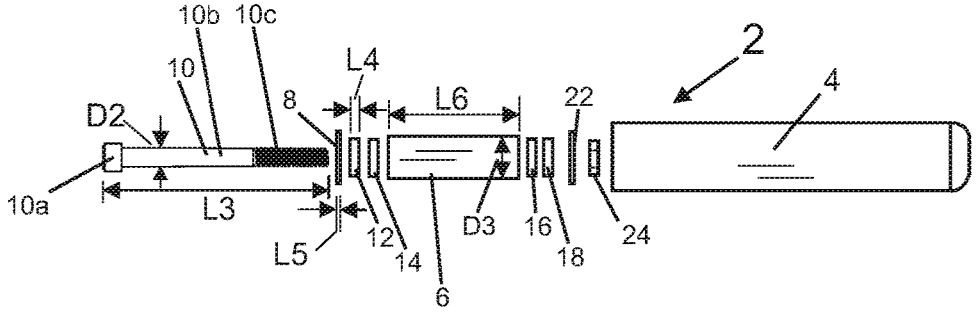
FIG. 4B shows a right side view of the spinning device of FIG. 2A, with the spinning device of FIG. 2A shown taken apart.
Figure 4C:
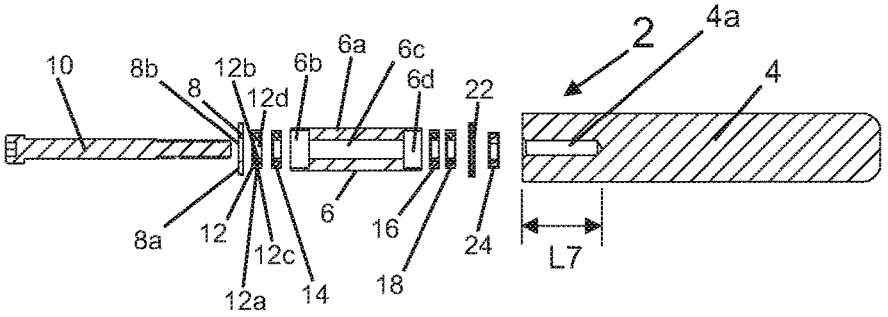
FIG. 4C shows a cross sectional view of the spinning device of FIG. 2A, with the spinning device taken apart.

FIG. 4A shows a cross sectional view of the spinning device 2 of FIG. 2A, with the spinning device 2 assembled. FIG. 4B shows a right side view of the spinning device 2 of FIG. 2A, with the spinning device 2 of FIG. 2A shown taken apart. FIG. 4C shows a cross sectional view of the spinning device 2 of FIG. 2A, with the spinning device 2 taken apart.

Referring to FIGS. 4A-4B, the overall spinning device 2, when assembled, has a length L1, which may be about 6.836 inches. The bar 4 may have a length L2 of about 4.775 inches. The inner diameter D1 of the member 6 may be about 0.257 inches. The outer diameter D2 of the portion 10*b* of the bolt 10 may be slightly less than 0.257 inches for a tight fit. The length L3 of the bolt 10 may be about 2.75 inches. The length L5 of the washer 8 and washer 22 may be about 0.061 inches. The length L4 of the ball bearing 12 may be about 0.125 inches. The length L6 of the member 6 may be about 1.750 inches. Referring to FIG. 4C, the length of the bore 4*a* into the rod or member 4 may be about 0.750 inches, and the diameter of the bore 4*a* may be about 0.201 inches. The outer diameter D3, shown in FIG. 4B, of the member 6 may be about 0.562 inches. The inner diameter D4, shown in FIG. 3B, of the opening 84 and the bore 86 may be about 0.5 inches, or less, which is less than the outer diameter D3 of the member 6, shown in FIG. 4B, and in order to insert the member 6 into the bore 86 (of FIG. 2A), the member 6 must be pushed into the bore 86 by high pressure, in line with the longitudinal axis (i.e. along its length) of the member 6.

Figure 5A:
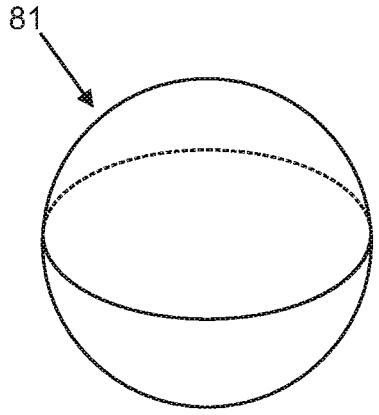
FIG. 5A shows a perspective view of a ball which is used to form the inner ball of FIG. 2A.
Figure 5B:
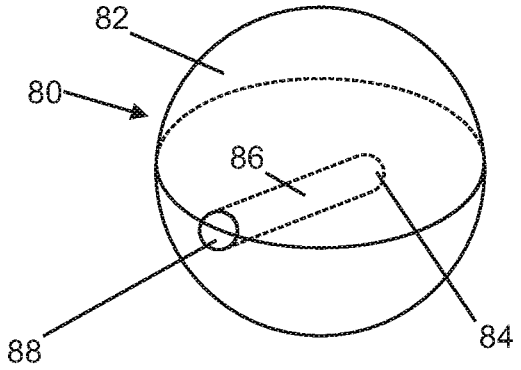
FIG. 5B shows a perspective view of the inner ball which has been formed from the ball of FIG. 5A.

FIG. 5A shows a perspective view of an inner ball 81 which is used to form the inner ball 80 of FIG. 2A and FIG. 5B. The inner ball 81 may be the inner core of a regulation softball (or regulation baseball or other ball). The ball 80 is formed by drilling a hole part way into the inner ball 81, typically through a cover of a ball. The cover of the ball has not been shown, in FIGS. 5A-5B, for ease of description, but typically, one would drill through the cover of the ball, and part way into the inner core, such as into a cover of either ball 90 or 94, in the orientation, and at the location, shown in either FIG. 1A or FIG. 10. FIG. 5B shows a perspective view of the inner ball 80 which has been formed from the ball 81 of FIG. 5A.

Figure 6B:
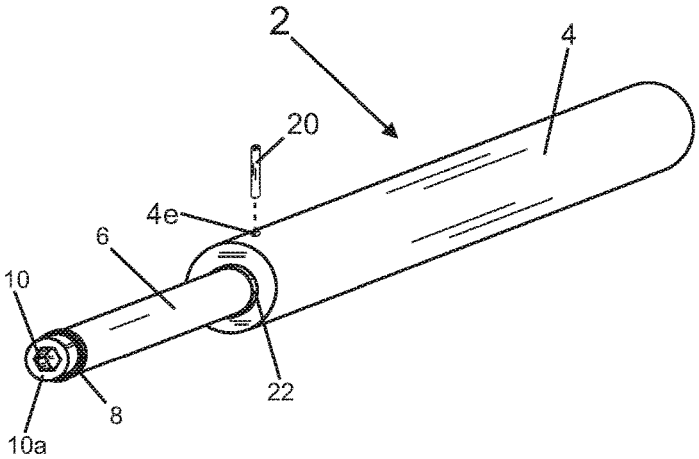
FIG. 6B shows a front, top, and right side perspective view of the spinning device of FIG. 2A, with the spinning device assembled.
Figure 9A:
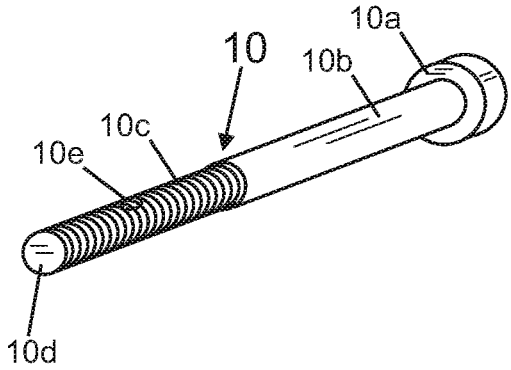
FIG. 9A shows a front, top, and right side perspective view of a bolt or attachment device, used for the spinning device of FIG. 2A.

FIG. 6A shows a front, top, and right side perspective view of the spinning device 2 of FIG. 2A, with the spinning device 2 taken apart. FIG. 6A shows components 10, 8, 12, 14, 6, 16, 18, 22, 24, 20, and 4. In order to assemble the spinning device 2, end 10*d* of the bolt 10 is inserted through the opening 8*b* of the washer 8, through the opening 12*d* of the ball bearing 12, through the opening 14*d* of the ball bearing 14, through the openings 6*b*, 6*c*, and 6*d* of the member 6, through the opening 16*d* of the ball bearing 16, through the opening 18*d* of the ball bearing 18, through the opening 22*b* of the washer 22, screwed through the opening 24*b* of the nut 24, and screwed into the bore 4*a*. The threaded portion 10*c* of the bolt 10 is screwed into the inner threads of the bore 4*a* to attach the bolt 10, washer 8, bearings 12, 14, member 6, bearings 16, and 18, washer 22, and nut 24, to the bar or member 4 as shown in FIG. 6B and FIG. 4A. Then, a hole or bore 4*e*, shown in FIG. 6A, and hole or bore 10*e* shown by dashed lines in FIG. 9A, is drilled through bar 4 and bolt 10, respectively, to hold the bolt 10 securely to the bar or handle 4. FIG. 6B shows a front, top, and right side perspective view of the spinning device 2 of FIG. 2A, with the spinning device assembled.

Figure 7A:
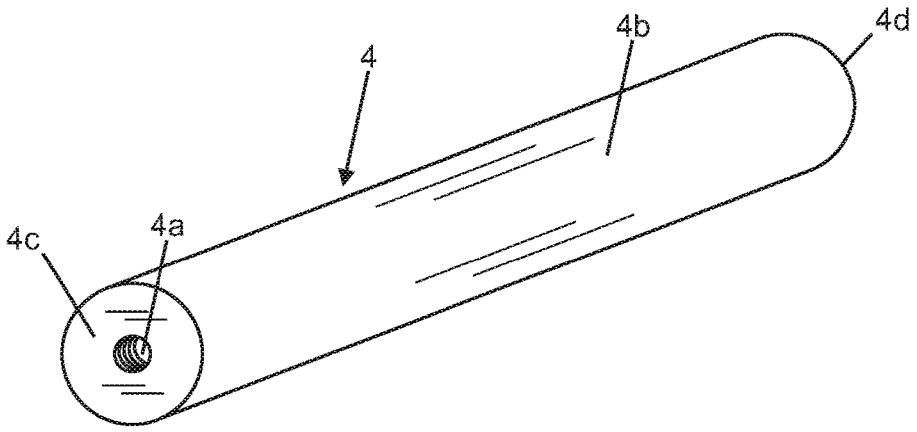
FIG. 7A shows a front, top, and right side perspective view of a rod, post, or bar, used for the spinning device of FIG. 2A.
Figure 7B:
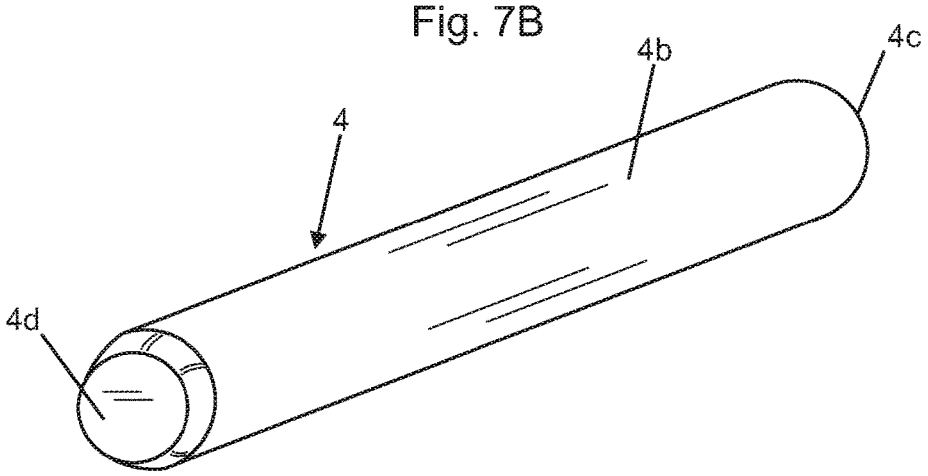
FIG. 7B shows a rear, bottom, and right side perspective view of the rod, post, or bar of FIG. 7A; used for the spinning device of FIG. 2A.

FIG. 7A shows a front, top, and right side perspective view of a rod, post, or bar 4, used for the spinning device 2 of FIG. 2A. FIG. 7B shows a rear, bottom, and right side perspective view of the rod, post, or bar 4 of FIG. 7A; used for the spinning device 2 of FIG. 2A. The rod, post or bar 4 may include a solid cylindrical body portion 4*b*, inner bore 4*a*, and ends 4*c* and 4*d*. The end 4*d* may be curved and smooth to avoid hurting one's hand when an individual grips the body portion 4*b*, while spinning a ball, such as ball 90 or 94, or while another spins a ball 90 or 94. FIGS. 7A-7B does not show the hole or bore 4*e*, which has not yet been drilled into the bar or handle 4.

FIG. 8A shows a front, top, and right side perspective view of the member 6, used for the spinning device 2 of FIG. 2A. FIG. 8B shows a rear, bottom, and right side perspective view of the member 6 of FIG. 8A; used for the spinning device 2 of FIG. 2A. The member 6 includes body portion 6*a*, inner regions 6*b*, 6*c*, and 6*d*.

Figure 9B:
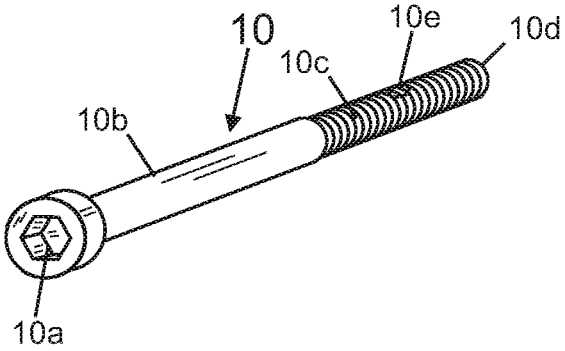
FIG. 9B shows a rear, bottom, and right side perspective view of the bolt or attachment device of FIG. 9A; used for the spinning device of FIG. 2A.

FIG. 9A shows a front, top, and right side perspective view of the bolt or attachment device 10, used for the spinning device 2 of FIG. 2A. FIG. 9B shows a rear, bottom, and right side perspective view of the bolt or attachment device 10 of FIG. 9A; used for the spinning device 2 of FIG. 2A. FIGS. 9A-B show by dashed lines where the hole or bore 10*e* would be drilled through the bolt 10, perpendicularly to the length of the bolt 10, after the bolt 10 has been screwed into opening or bore 4*a* of the bar 4.

Figure 10A:
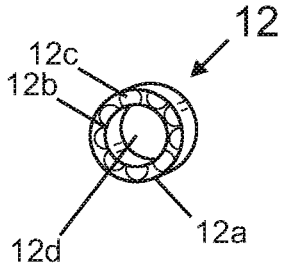
FIG. 10A shows a front, top, and right side perspective view of a ball bearing, used for the spinning device of FIG. 2A.
Figure 10B:
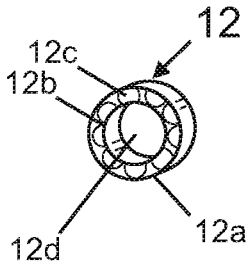
FIG. 10B shows a rear, bottom, and right side perspective view of the ball bearing, used for the spinning device of FIG. 2A.

FIG. 10A shows a front, top, and right side perspective view of the ball bearing 12, used for the spinning device 2 of FIG. 2A. FIG. 10B shows a rear, bottom, and right side perspective view of the ball bearing 12, used for the spinning device 2 of FIG. 2A. FIG. 11A shows a front, top, and right side perspective view of a washer 8, used for the spinning device 2 of FIG. 2A. FIG. 11B shows a rear, bottom, and right side perspective view of the washer 8, used for the spinning device of FIG. 2A.

In operation, referring to FIG. 1A, a person can grip and/or grasp the bar 4 of the spinning device 2 with one hand, such as a left hand, for example, and can simultaneously spin the ball 90 in clockwise C1 or counterclockwise C2 directions, as shown in FIG. 2C with the other hand, such as a right hand, to work on wrist exercises or training such as for softball pitching. Alternatively, someone else can hold the bar 4, while another person spins the ball 90 or 94 (thereby spinning inner ball 80). However, the apparatus 1 or 100 has been constructed so that it can be conveniently used by one person, in at least one or more embodiments.

The spinning device 2, bar 4, and member 10, all have the same, or substantially the same longitudinal axis L8 shown in FIG. 3B, about which the member 10 (and the ball 80 and/or balls 90 and 94) rotates with respect to the bar 4.

The components 4, 6, 8, 10, 12, 14, 16, 18, 22, and 24 may be made of a hard rigid metal such as steel, or aluminum.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a bar having a length and a width, wherein the length is substantially greater than the width, and having a longitudinal axis along the length of the bar;

a member which is connected to the bar and aligned with the bar so that the member has a longitudinal axis which is the same as the longitudinal axis of the bar;

a fastener which is fixed to the bar so that the fastener does not rotate with respect to the bar;

a ball fixed to the member so that the ball does not rotate with respect to the member, but does rotate with respect to the bar;

wherein the member has a length along the longitudinal axis of the member;

wherein the fastener spans a majority of the length of the member and resides partly inside of the member; and wherein a majority of the member and a majority of the fastener reside inside of the ball;

wherein the member is connected to the bar by the fastener so that the member rotates with respect to the bar, about the longitudinal axis of the bar;

wherein the ball has a bore hole formed into the ball, wherein the bore hole terminates inside a core of the ball, so that the bore hole does not go all the way through the ball;

wherein the member is fixed to the ball, by insertion of the member into the bore hole; and wherein a majority of the member and the fastener reside in the bore hole;

wherein the bore hole of the ball has a diameter, which has a rest measurement, prior to insertion of the member, which is less than a diameter of the member, so that the bore hole diameter must expand by pressure, in order for the member to be inserted into the bore hole;

wherein the ball is a regulation softball that has been modified by having the bore hole drilled in the regulation softball;

further comprising a first ball bearing inserted in the member, nearer the first end of the member than the second end of the member, the first ball bearing residing inside of the ball, and within a first recess of the member; and a second ball bearing inserted in the member, nearer the second end of the member than the first end of the member, the second ball bearing residing inside of the ball, and within a second recess of the member;

wherein the first recess of the member has an inner diameter;

wherein the second recess of the member has an inner diameter which is the same as the inner diameter of the first recess of the member;

wherein a central part of the member, which is located between the first recess and the second recess of the member, has an inner diameter which is less than the inner diameter of the first recess and less than the inner diameter of the second recess;

wherein each of the first and the second ball bearings has an outer diameter such that neither the first ball bearing nor the second ball bearing can fit in the central part of the member; and wherein the central part of the member has a length which is substantially greater than a combination of a length of the first recess and a length of the second recess.

2. The apparatus of claim 1 wherein the fastener is a bolt.

3. The apparatus of claim 2 wherein the bolt is fixed to the bar by a tension pin which is perpendicular to a length of the bolt and to the length of the bar; and wherein the tension pin is inserted into a combination bore formed by drilling through the bar and the fastener, after a threaded portion of the fastener has been screwed into inner threads of an inner bore of the bar.

4. The apparatus of claim 1 wherein the diameter of the member is approximately 0.562 inches; and wherein the rest measurement of the diameter of the bore hole of the ball, prior to insertion of the member into the bore hole, is approximately 0.5 inches.

5. The apparatus of claim 1 further comprising a first washer connected to the bolt and the member, between a head of the fastener and a first end of the member; and a second washer connected to the member and the bar, between a second end of the member, opposite the first end of the member, and a first end of the bar; and wherein the first washer resides inside of the ball.

6. The apparatus of claim 1 wherein the first ball bearing has an inner opening with an inner diameter; and wherein the fastener partly, resides within the inner opening of the first ball bearing.

7. The apparatus of claim 6 further comprising a second ball bearing having an inner opening with an inner diameter;

wherein the fastener partly, resides within the inner opening of the second ball bearing.

8. The apparatus of claim 1 wherein the ball is connected to the bar so that a plurality of seams of the ball are substantially parallel to the bar and remain substantially parallel to the bar when the ball is rotated with respect to the bar; and a plurality of seams of the ball are substantially perpendicular to the bar, and remain substantially perpendicular to the bar when the ball is rotated with respect to the bar.

9. The apparatus of claim 4 wherein the bore hole has a length which is approximately half a diameter of the ball.

10. An apparatus comprising:

a bar having a length and a width, wherein the length is substantially greater than the width, and having a longitudinal axis along the length of the bar;

a member which is connected to the bar and aligned with the bar so that the member has a longitudinal axis which is the same as the longitudinal axis of the bar;

a fastener which is fixed to the bar so that the fastener does not rotate with respect to the bar;

a ball fixed to the member so that the ball does not rotate with respect to the member, but does rotate with respect to the bar;

wherein the member has a length along the longitudinal axis of the member;

wherein the fastener spans a majority of the length of the member and resides partly inside of the member; and wherein a majority of the member and a majority of the fastener reside inside of the ball;

wherein the member is connected to the bar by the fastener so that the member rotates with respect to the bar, about the longitudinal axis of the bar;

wherein the ball has a bore hole formed into the ball, wherein the bore hole terminates inside a core of the ball, so that the bore hole does not go all the way through the ball;

wherein the member is fixed to the ball, by insertion of the member into the bore hole; and wherein a majority of the member and the fastener reside in the bore hole;

wherein the bore hole of the ball has a diameter, which has a rest measurement, prior to insertion of the member, which is less than a diameter of the member, so that the bore hole diameter must expand by pressure, in order for the member to be inserted into the bore hole;

wherein the ball is a regulation softball that has been modified by having the bore hole drilled in the regulation softball;

wherein the length of the bar is greater than a diameter of the ball;

wherein the majority of the bar is a solid cylinder;

wherein an inner bore is located inside of the bar;

wherein the fastener is fixed to the bar by partial insertion of the fastener into the inner bore of the bar;

wherein the bar has a first end at which a first end of the inner bore of the bar is located;

wherein the inner bore of the bar has a second end, opposite the first end of the inner bore of the bar;

wherein the inner bore of the bar has a length from the first end of the inner bore of the bar to the second end of the inner bore of the bar;

wherein the length of the bar is substantially greater than the length of the inner bore of the bar; and wherein the bar has a second end, opposite the first end of the bar, and wherein the second end of the bar is free.

11. A method comprising the steps of:

inserting a member of an apparatus into a bore hole of a ball, to thereby attach the member and the apparatus to the ball, so that the member is fixed to the ball, and the member and the ball rotate with respect to a bar of the apparatus; and wherein the bore hole terminates inside of the ball so that the member enters the ball, but the member does not go all the way through the ball;

wherein the member is connected to the bar by a fastener so that the member rotates with respect to the bar, about the longitudinal axis of the bar;

wherein the fastener is fixed to the bar so that the fastener does not rotate with respect to the bar;

wherein the ball is fixed to the member so that the ball does not rotate with respect to the member, but does rotate with respect to the bar;

wherein the member has a longitudinal axis and a length along the longitudinal axis of the member;

wherein the fastener spans a majority of the length of the member and resides partly inside of the member;

wherein a majority of the member and a majority of the fastener reside inside of the ball;

wherein the step of inserting the member of the apparatus into the bore hole of the ball includes using a drill press to insert the member of the apparatus into the bore hole; and wherein prior to insertion of the member into the bore hole of the ball, the member has a diameter and the bore hole has a diameter, and the diameter of the member is greater than the diameter of the bore hole, so that pressure must be applied to insert the member into the bore hole to cause the bore hole diameter to expand; and wherein the ball is a regulation softball that has been modified by having the bore hole drilled in the regulation softball;

wherein the apparatus includes a first ball bearing inserted in the member, nearer the first end of the member than the second end of the member, the first ball bearing residing inside of the ball, and within a first recess of the member; and a second ball bearing inserted in the member, nearer the second end of the member than the first end of the member, the second ball bearing residing inside of the ball, and within a second recess of the member;

wherein the first recess of the member has an inner diameter;

wherein the second recess of the member has an inner diameter which is the same as the inner diameter of the first recess of the member;

wherein a central part of the member, which is located between the first recess and the second recess of the member, has an inner diameter which is less than the inner diameter of the first recess and less than the inner diameter of the second recess;

wherein each of the first and the second ball bearings has an outer diameter such that neither the first ball bearing nor the second ball bearings can fit in the central part of the member; and wherein the central part of the member has a length which is substantially greater than a combination of a length of the first recess and a length of the second recess.

12. The method of claim 11 wherein the bar has a length and a width, wherein the length is substantially greater than the width, and the bar has a longitudinal axis along its the length of the bar;

the member is connected to the bar and aligned with the bar so that the member has a longitudinal axis which is the same as the longitudinal axis of the bar; and wherein the member is connected to the bar so that the member rotates with respect to the bar, about the longitudinal axis of the bar; and wherein a majority of the member and a majority of the fastener reside in the bore hole.

13. The method of claim 11 wherein the diameter of the member is approximately 0.562 inches; and wherein the rest measurement of the diameter of the bore hole of the ball, prior to insertion of the member into the bore hole, is approximately 0.5 inches.

14. The method of claim 11 wherein the fastener is a bolt; and wherein the bolt is fixed to the bar by a tension pin which is perpendicular to a length of the bolt and to the length of the bar; and wherein the tension pin is inserted into a combination bore formed by drilling through the bar and the fastener, after the fastener has been inserted into an inner bore of the bar.

15. The method of claim 11 wherein the apparatus includes a first washer connected to the fastener and the member, between a head of the fastener and a first end of the member; and a second washer connected to the member and the bar, between a second end of the member, opposite the first end of the member, and a first end of the bar; and wherein the first washer resides inside of the ball.

16. A method comprising the steps of:

inserting a member of an apparatus into a bore hole of a ball, to thereby attach the member and the apparatus to the ball, so that the member is fixed to the ball, and the member and the ball rotate with respect to a bar of the apparatus; and wherein the bore hole terminates inside of the ball so that the member enters the ball, but the member does not go all the way through the ball;

wherein the member is connected to the bar by a fastener so that the member rotates with respect to the bar, about the longitudinal axis of the bar;

wherein the fastener is fixed to the bar so that the fastener does not rotate with respect to the bar;

wherein the ball is fixed to the member so that the ball does not rotate with respect to the member, but does rotate with respect to the bar;

wherein the member has a longitudinal axis and a length along its the longitudinal axis of the member;

wherein the fastener spans a majority of the length of the member and resides partly inside of the member;

wherein a majority of the member and a majority of the fastener reside inside of the ball;

wherein the step of inserting the member of the apparatus into the bore hole of the ball includes using a drill press to insert the member of the apparatus into the bore hole; and wherein prior to insertion of the member into the bore hole of the ball, the member has a diameter and the bore hole has a diameter, and the diameter of the member is greater than the diameter of the bore hole, so that pressure must be applied to insert the member into the bore hole to cause the bore hole diameter to expand; and wherein the ball is a regulation softball that has been modified by having the bore hole drilled in the regulation softball;

wherein the length of the bar is greater than a diameter of the ball;

wherein the majority of the bar is a solid cylinder;

wherein an inner bore is located inside of the bar;

wherein the fastener is fixed to the bar by partial insertion of the fastener into the inner bore of the bar;

wherein the bar has a first end at which a first end of the inner bore of the bar is located;

wherein the inner bore of the bar has a second end, opposite the first end of the inner bore of the bar;

wherein the inner bore of the bar has a length from the first end of the inner bore of the bar to the second end of the inner bore of the bar;

wherein the length of the bar is substantially greater than the length of the inner bore of the bar; and wherein the bar has a second end, opposite the first end of the bar, and wherein the second end of the bar is free.

* * * * *